United States Patent [19]

Chez

[11] 4,262,774

[45] Apr. 21, 1981

[54] ADJUSTABLE SCAFFOLD

[76] Inventor: Roman Chez, 1230 Forget St., Regina, Saskatchewan, Canada

[21] Appl. No.: 97,316

[22] Filed: Nov. 26, 1979

[51] Int. Cl.[3] ..... E04G 1/18; E04G 1/28

[52] U.S. Cl. ..... 182/179; 182/119

[58] Field of Search ..... 182/119, 118, 178, 179, 182/184; 292/87, 207; 403/378, 317, 316; 211/192

[56] References Cited

U.S. PATENT DOCUMENTS

| | | | |
|---|---|---|---|
| 601,546 | 3/1898 | Boothman | 292/207 |
| 1,094,332 | 4/1914 | Hubbard | 403/316 |
| 1,499,300 | 6/1924 | Hayes | 182/205 |
| 2,172,761 | 9/1939 | Curtis | 292/87 |
| 2,538,435 | 1/1951 | Wegner | 403/316 |
| 2,593,122 | 4/1952 | Droeger | 182/118 |
| 2,974,965 | 3/1961 | Welles | 403/378 |
| 3,273,720 | 9/1966 | Seiz | 211/192 |
| 3,396,817 | 8/1968 | Perry | 182/179 |

*Primary Examiner*—Reinaldo P. Machado
*Attorney, Agent, or Firm*—Stanley G. Ade

[57] ABSTRACT

A scaffold construction includes a fixed leg portion and an adjustable platform portion with a spring loaded pin connection operatively connecting between the two to selectively lock the leg and the platform in the required relationship. The pin is mounted on one end of a leaf spring which in turn is secured to the platform and engages any one of a plurality of apertures in the leg portion. A gravity operated locking device normally prevents inadvertent disengagement of the pin from the leg unless it is moved upwardly manually thus preventing accidental and inadvertent collapse of the platform relative to the leg.

6 Claims, 5 Drawing Figures

ADJUSTABLE SCAFFOLD

BACKGROUND OF THE INVENTION

This invention relates to new and useful improvements in adjustable scaffolds, particularly adjustable scaffolds such as those illustrated and described in U.S. Pat. No. 3,396,817 dated Aug. 13, 1968.

In this U.S. patent, a locking device is provided between the platform mounting portion and the leg around which the mounting portion extends. It includes a spring loaded pin which can be withdrawn from an aperture within the leg thus allowing the platform to slide relative to the leg whereupon the pin is released and the spring engages the pin within the selected aperture thus supporting the platform relative to the leg. Means are provided to lock the pin in the engaged position and take the form of a nut device which is rotated upon the pin and screw threadably engages a fixed portion on the platform so that the pin cannot vibrate or be moved to the disengaged position unless the nut is unscrewed from the fixed screw threaded portion. Unfortunately, the nut is difficult to manipulate into engagement with the screw threaded portion due to the fact that a mounting shroud for the pin surrounds the pin and the nut. It is particularly difficult to manipulate the nut in cold weather when the operator is wearing gloves and the like so that it is normal for operators not to bother with the safety device, namely engaging the nut with the fixed screw threaded portion in order to prevent an inadvertent withdrawing of the pin and the subsequent collapse of the platform.

The result has been several accidents in which the platform has collapsed at one end thus allowing materials and operators or workmen to be spilled from the platform and although such platforms are often operated at a relatively low height from the ground, nevertheless they can be situated at a considerable distance above the ground so that injuries have occurred not only to workmen or operators falling from the platform, but due to material falling from the platform and striking personnel situated close to or below the platform.

SUMMARY OF THE INVENTION

The present device overcomes these disadvantages by providing a spring loaded latch means which is locked in the engaged position by a simple gravity operated locking member so that the locking member is easily elevated to release the latch pin when desired and the latch pin is easily withdrawn even with personnel wearing relatively heavy gloves. In accordance with the invention, there is provided an adjustable scaffolding which includes vertically extending supporting legs, a platform extending therebetween, and means operatively connected and supporting the platform to the legs for selective vertical movement therealong. Releasable latch means are provided operatively connected between each of said legs in said platform, said releasable latch means including a spring loaded latch pin on said platform selectively engageable with any one of a plurality of latch pin engaging means on said legs. Means to selectively lock said latch pin in the closed position are also included, said spring loaded latch pin including a leaf spring secured by one end thereof to said platform, a latch pin extending therefrom, said leaf spring normally urging said latch pin towards the leg engaging position. Further means are present to move said latch pin away from said leg engaging position against pressure of said leaf spring.

The locking means includes a locking member mounted for vertical sliding movement to the platform above the leaf spring and adjacent the upper end thereof. Means are provided on the locking member engageable over the other end of said leaf spring when the latch pin is in the closed position.

Another advantage of the present invention is to provide a device which is simple in construction, economical in operation and which is otherwise well suited to the purpose for which it is designed.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
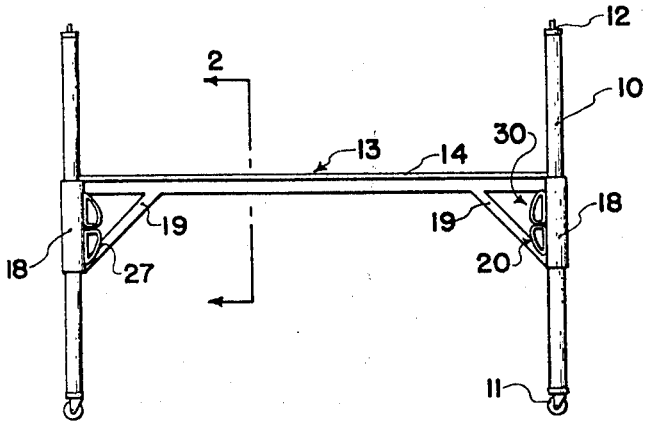
FIG. 1 is a side elevational view of an adjustable scaffolding with the invention incorporated therewith.
Figure 2:
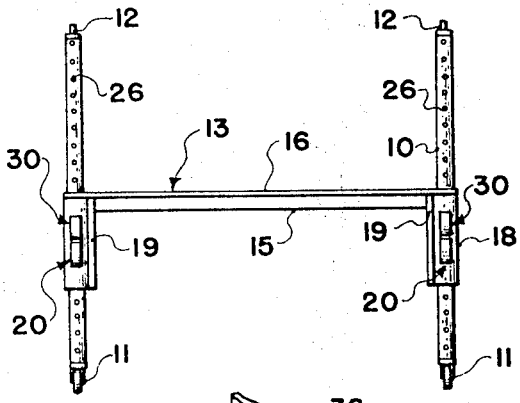
FIG. 2 is an end sectional view of FIG. 1 taken along the line 2—2 thereof.

Proceeding therefore to describe the invention in detail, the adjustable scaffold normally consists of four vertically extending legs, two only of which are shown and which are indicated by reference character 10. In the particular structure illustrated in FIG. 1, castor wheels 11 are mounted on the lower ends thereof, and upwardly extending pins 12 on the upper ends thereof so that a further scaffolding leg construction can be stacked thereon as is usual in such scaffolds.

A substantially rectangular platform collectively designated 13, is slidably engaged between the legs 10 and is movable vertically, said scaffolding including longitudinal side members 14 and transverse end members 15 with a planar platform 16 spanning the members 14 and 15 and in this embodiment, the members 14 and 15 may either be in the form of angle iron material as indicated by reference character 17 or U-shaped channelling or the like.

The platform is supported upon the legs for vertical movement thereon by support portions 18 which may take the form of U-shaped channels or leg embracing sleeves as desired and these supports 18 may be braced to the side members 14 by means of diagonal braces 19 or the equivalent, it being understood that the members 14, 15 and 19 may be welded together or otherwise secured as desired.

Releasable latch means are provided collectively designated 20 and take the form of an elongated leaf spring 21 secured as by welding or the equivalent, by one end thereof to adjacent the lower end of the support 18, said lower end of the leaf spring being indicated by reference character 22.

A latch pin 23 extends perpendicularly from adjacent the upper end 24 of the spring and freely engages through an aperture 25 formed in the wall of the support 18 and the resiliency of the leaf spring is such that it normally urges the pin 23 inwardly or into engagement through aperture 25.

Figure 3:
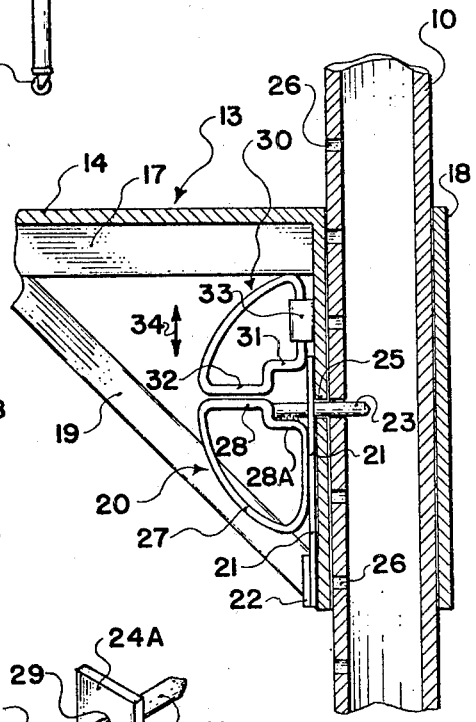
FIG. 3 is a fragmentary enlarged detail of one of the locking devices.
Figure 4:
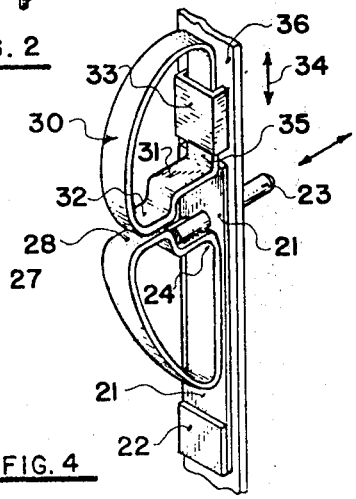
FIG. 4 is an isometric view of the locking device per se.

A plurality of further apertures 26 are formed through the wall of the leg 10 and the latch pin 23 is long enough so that when it is in the innermost position as illustrated in FIGS. 3 and 4, it also engages any one of the apertures 26, depending upon the manual adjustment of the platform prior to engagement of the pin with the aperture 26.

Means are provided to withdraw pin 23 from apertures 26 when it is desired to move the platform vertically relative to the legs 10, said means taking the form of a curved or looped hand engaging strap 27 which is secured to adjacent the upper end of the leaf spring 21 as by welding or the like, on the side opposite to that from which the pin 23 extends.

This curved strap forms a hand engaging portion thus enabling the pin to be withdrawn against pressure of spring 21 even if the operator is wearing gloves or mitts.

Figure 5:
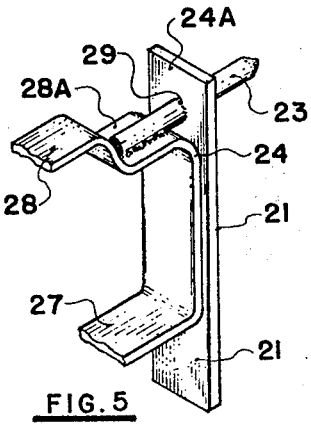
FIG. 5 is a section along the line 5—5.

FIG. 5 shows the upper side 28 of the hand engaging portion 27 with the inner end 28A depressed relative to the upper side 28. The pin 23 extends through a drilling 29 formed in the other end of the leaf spring and is welded to the depressed portion 28A to give additional support to the pin as clearly shown.

A locking member is provided collectively designated 30 and is also in the form of a hand engaging strap curved in a manner similar to the member 27 and also having a jogged portion 31 situated in this instance, on the inner end of the lower portion 32 of the locking member. This locking member can be moved vertically within a bracket 33 extending from the support 18 of the platform, said bracket acting as a guide or sheave for limited vertical movement of the locking member in the direction of double headed arrow 34.

The guide or sheave 33 is positioned so that the lower portion of the vertical strip 35 of the locking member is spaced from the surface 36 of the support 18. It will also be observed that the pin 23 is secured to the leaf spring 21 spaced downwardly from the upper extremity or end 24A of the leaf spring which normally lies against the surface of the support 18 when in the innermost position illustrated in FIGS. 3 and 4.

This means that gravity will move the locking member downwardly in the position shown in FIG. 3 so that the lower end of the vertical portion 35 of the locking member overlaps the upper end portion 24A of the leaf spring thereby preventing inadvertent withdrawal of the pin 23 from the aperture 26 in which it is engaged unless the locking member 30 is manually moved upwardly against gravity thereby clearing the upper end 24A of the spring and allowing manual withdrawal of the pin.

From the foregoing it will be appreciated that it is not possible to engage pin 23 within an aperture 26 without the locking member 30 automatically moving downwardly by gravity and detachably locking the latching device in the closed or engaged position.

By the same token, withdrawal of the pin 23 requires a positive upward movement of the locking member 30 before the pin can be withdrawn so that inadvertent displacement and subsequent accidents cannot occur with this device.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. Adjustable scaffolding which includes vertically extending supporting legs, a platform extending therebetween, and means operatively connecting and supporting the platform to the legs for selective vertical movement therealong; releasable latch means operatively connected between each of said legs in said platform, said releasable latch means including a spring loaded latch pin on said platform selectively engageable with any one of a plurality of latch pin engaging means on said legs and means to selectively lock said latch pin in the closed position, said spring loaded latch pin including a leaf spring secured by one end thereof to said platform, a latch pin extending therefrom, said leaf spring normally urging said latch pin towards the leg engaging position, and means to move said latch pin away from said leg engaging position against pressure of said leaf spring, said means to selectively lock said latch pin including a locking member mounted for vertical sliding movement to said platform above said leaf spring and adjacent the upper end thereof and means on said locking member automatically engaging over said other end of said leaf spring when said latch pin is in the closed position.

2. The releasable latch means according to claim 1 in which said platform includes a leg engaging portion, said leg engaging portion being apertured, said latch pin extending freely through said aperture.

3. The releasable latch means according to claim 1 in which said latch pin extends perpendicular to said leaf spring from one side thereof and adjacent the other end thereof, said means to move said latch pin away from said leg engaging position including a hand engaging portion secured to said leaf spring on the side thereof opposite to said latch pin.

4. The releasable latch means according to claim 2 in which said latch pin extends perpendicular to said leaf spring from one side thereof and adjacent the other end thereof, said means to move said latch pin away from said leg engaging position including a hand engaging portion secured to said leaf spring on the side thereof opposite to said latch pin.

5. The releasable latch means according to claims 1, 2 or 3 in which said locking member engages over said other end of said leaf spring by gravity.

6. The releasable latch means according to claim 4 in which said locking member engages over said other end of said leaf spring by gravity.

* * * * *